US008193745B2

(12) United States Patent
Ledoux et al.

(10) Patent No.: US 8,193,745 B2
(45) Date of Patent: Jun. 5, 2012

(54) FILTERING AND BOOSTING A SIGNAL FROM A DRIVE CIRCUIT

(75) Inventors: Kurt J. Ledoux, Houston, TX (US); Christos J. Salmas, Edmonton, CA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1673 days.

(21) Appl. No.: 10/908,488

(22) Filed: May 13, 2005

(65) Prior Publication Data

US 2006/0257266 A1 Nov. 16, 2006

(51) Int. Cl.
*H02P 1/00* (2006.01)
*H02P 3/00* (2006.01)
*H02P 5/00* (2006.01)

(52) U.S. Cl. ..... 318/268; 318/780; 318/782; 417/44.1; 417/45; 417/321

(58) Field of Classification Search ..... 318/268, 318/780, 782; 417/44.1, 45, 321
See application file for complete search history.

(56) References Cited

U.S. PATENT DOCUMENTS

| | | | | |
|---|---|---|---|---|
| 3,610,779 | A | 10/1971 | Hubby | |
| 3,716,130 | A | 2/1973 | Morris | |
| 3,876,923 | A | 4/1975 | Humphrey | |
| 5,016,158 | A | 5/1991 | Matsui | |
| 5,234,319 | A | 8/1993 | Wilder | |
| 5,318,409 | A | 6/1994 | London | |
| 5,844,397 | A * | 12/1998 | Konecny et al. | 318/811 |
| 5,945,802 | A | 8/1999 | Konrad | |
| 6,070,760 | A | 6/2000 | Kenney | |
| 6,531,842 | B2 * | 3/2003 | LeDoux et al. | 318/629 |
| 6,631,296 | B1 * | 10/2003 | Parramon et al. | 607/61 |
| 7,161,456 | B2 * | 1/2007 | Knox | 336/90 |

FOREIGN PATENT DOCUMENTS

| | | |
|---|---|---|
| GB | 2212994 | 8/1989 |
| GB | 2378483 A | 2/2003 |
| GB | 2396064 A | 6/2004 |
| KR | 20050027287 | 3/2005 |

* cited by examiner

*Primary Examiner* — Walter Benson
*Assistant Examiner* — Erick Glass
(74) *Attorney, Agent, or Firm* — Jim D. Patterson

(57) ABSTRACT

A method and apparatus comprises a filter receiving an input voltage signal from a drive circuit, and a filter producing an output voltage signal with reduced resonance and transients. The amplitude of the output voltage signal is boosted using the filter.

20 Claims, 2 Drawing Sheets

FILTERING AND BOOSTING A SIGNAL FROM A DRIVE CIRCUIT

BACKGROUND

Variable speed voltage drive systems are used to vary the speed of motors, such as submersible motors used in submersible pumping systems deployed in wells. A typical submersible pumping system includes a pump and a motor, with the motor being electrically connected to a variable speed drive system over a cable that extends from the downhole location of the motor to an earth surface location of the variable speed drive system. The motor powers downhole components, such as the pump, to perform downhole tasks, such as to pump fluids from the downhole location to the earth surface. An example submersible motor is a three-phase induction-type motor. In the three-phase configuration, the variable speed drive system provides a three-phase input to the three-phase induction-type motor.

The load impedance of the cable and the downhole motor may cause resonance in signals from the variable speed drive system to the motor. The resonance is caused by undesirable harmonic components generated by the output of the drive system, which can cause voltage distortion and/or transients, zero-crossing noise, and other issues. To reduce resonance, a filter can be used to filter out harmonic components of each input signal from the variable speed drive system.

In some applications, the cable from the variable speed drive system to the downhole motor can be quite long, some as long as 25 kilometers or more. The long cable is associated with a large resistance that can cause a substantial voltage drop of each signal from the motor drive system along the cable. As a result, a separate step-up transformer (separate from the filter) typically has to be used to boost the voltage amplitude of an input signal from the variable speed drive system to compensate for the voltage drop along the cable. Use of separate units (a filtering unit and a voltage boost unit) to perform the filtering and amplitude boosting tasks may result in greater complexity and costs associated with deployment into a well of a submersible pump system, or other type of downhole system that includes a motor.

SUMMARY

In general, according to an embodiment, a method comprises receiving, at a filter, an input signal from a drive circuit. The filter produces an output signal with reduced resonance, and the filter also boosts the amplitude of the output signal.

Other or alternative embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Figure 1:
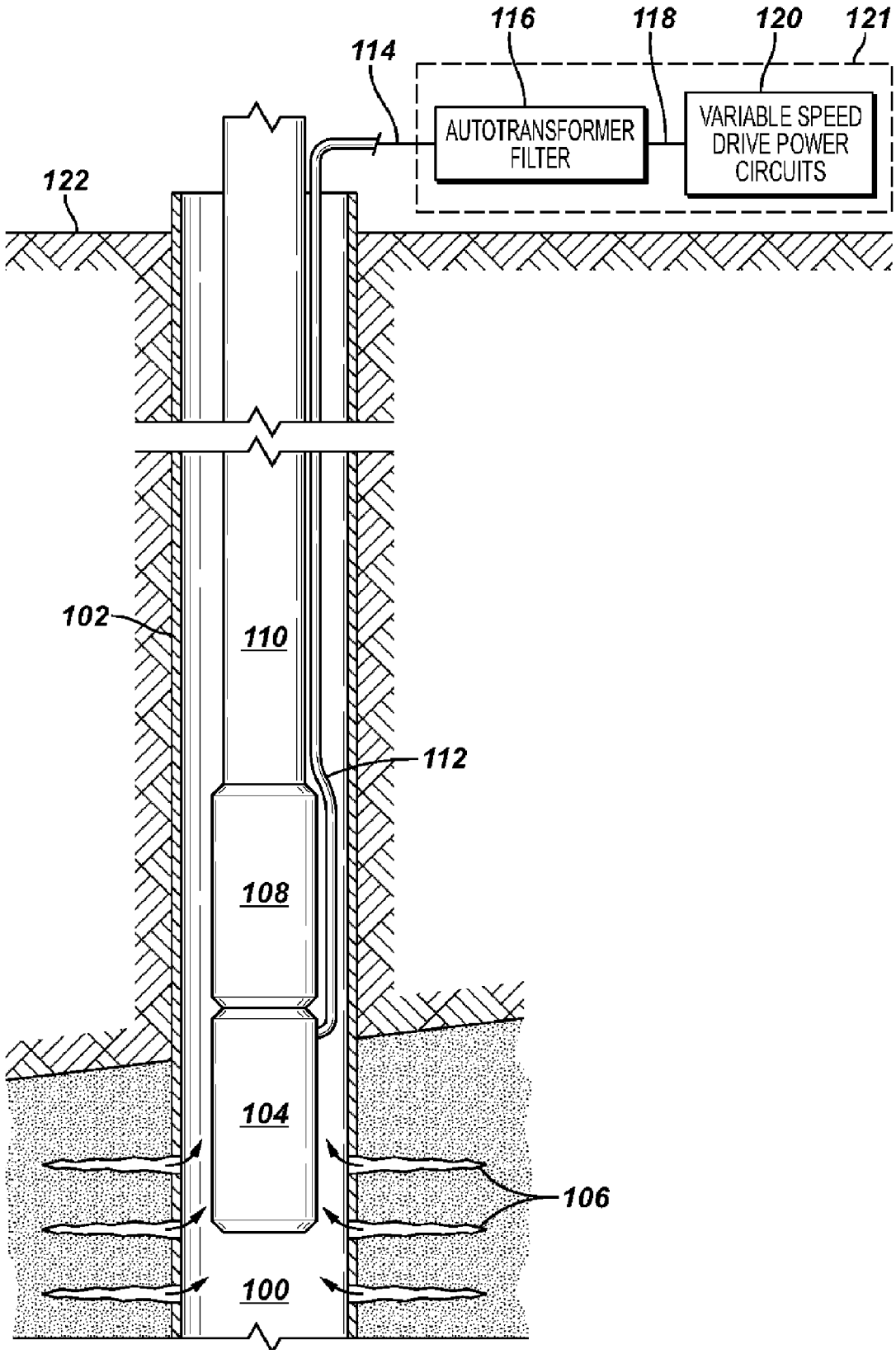
FIG. 1 illustrates an example production string that includes a motor that is driven by an output provided by an autotransformer filter according to an embodiment, where the autotransformer filter filters and boosts the output voltage of a variable speed drive circuit, and where the autotransformer filter and variable speed drive circuit are contained in the same enclosure.

FIG. 1 shows a downhole string deployed in a wellbore 100 that is lined by casing 102. The casing 102 has perforations 106 that enable communication of fluids, such as hydrocarbon fluids, between the wellbore 100 and a reservoir surrounding the wellbore 100. The downhole string, according to an example embodiment, includes a submersible motor 104, such as an induction-type motor. Other types of submersible motors can be used in other embodiments. The submersible motor 104 is part of a submersible pump system that also includes a pump 108. The downhole string is deployed into the wellbore 100 by a tubing 110. In other embodiments, the downhole string can be deployed by other deployment mechanisms, such as cables, slicklines, and so forth.

The submersible motor 104 is connected by a cable 112 to equipment located at an earth surface 122. The cable 112 extends along the length of the wellbore 100 between the earth surface 122 and the motor 104. The tubing 110 also extends to the earth surface from the submersible pump system. When activated by input signals transmitted over the cable 112, the motor 104 powers the pump 108 to pump fluids from the surrounding reservoir up the tubing 110 to the earth surface.

Although described in the context of a variable speed drive system for driving a submersible motor in a downhole environment, it is contemplated that other types of drive systems for driving other types of motors (whether used in downhole applications or otherwise) can be used in other embodiments.

The surface equipment that provides output signaling for communication over the cable 112 to the motor 104 includes a variable speed drive system 121, which includes variable speed drive power circuits 120 and an autotransformer filter 116, according to an embodiment. The variable speed drive circuits 120 and autotransformer filter 116 can be contained in the same enclosure. The autotransformer filter 116 receives an input 118 from the variable speed drive power circuits 120. The autotransformer filter 116 then provides an output 114 for communication over the cable 112 to the motor 104.

According to one embodiment, the input 118 is a three-phase input to the autotransformer filter 116, and the output 114 from the autotransformer filter is a three-phase output, which powers the three-phase induction-type motor 104. However, according to another embodiment, a single-phase input and output can be used. The three-phase input includes three input signals that are out of phase with respect to each other by 120°, and the three-phase output includes three output signals that are out of phase with respect to each other by 120°.

The autotransformer filter 116 filters out undesirable harmonic components from the input 118. Also, in accordance with some embodiments of the invention, the autotransformer filter 116 also boosts an amplitude of the output 114 such that the amplitude of the output 114 is greater than (stepped up from or boosted from) the amplitude of the input 118. According to an embodiment, the autotransformer filter 116 steps up the voltage of each input signal to a higher voltage at the output 114. Boosting the output voltage from the autotransformer filter 116 allows compensation for voltage loss caused by resistance of the cable 112. The voltage drop along a relatively long cable (such as 25 kilometers or greater) can be substantial.

In addition, by filtering out undesirable harmonic components in each input signal from output signal, resonance due to the load impedance provided by the cable 112 and motor 104 is reduced or eliminated. The ability of the autotransformer filter 116 to both perform filtering and amplitude boosting tasks reduces complexity in the equipment used for providing signals down the cable 112 to the motor 104, since use of separate filter and transformer units can be avoided.

Figure 2:
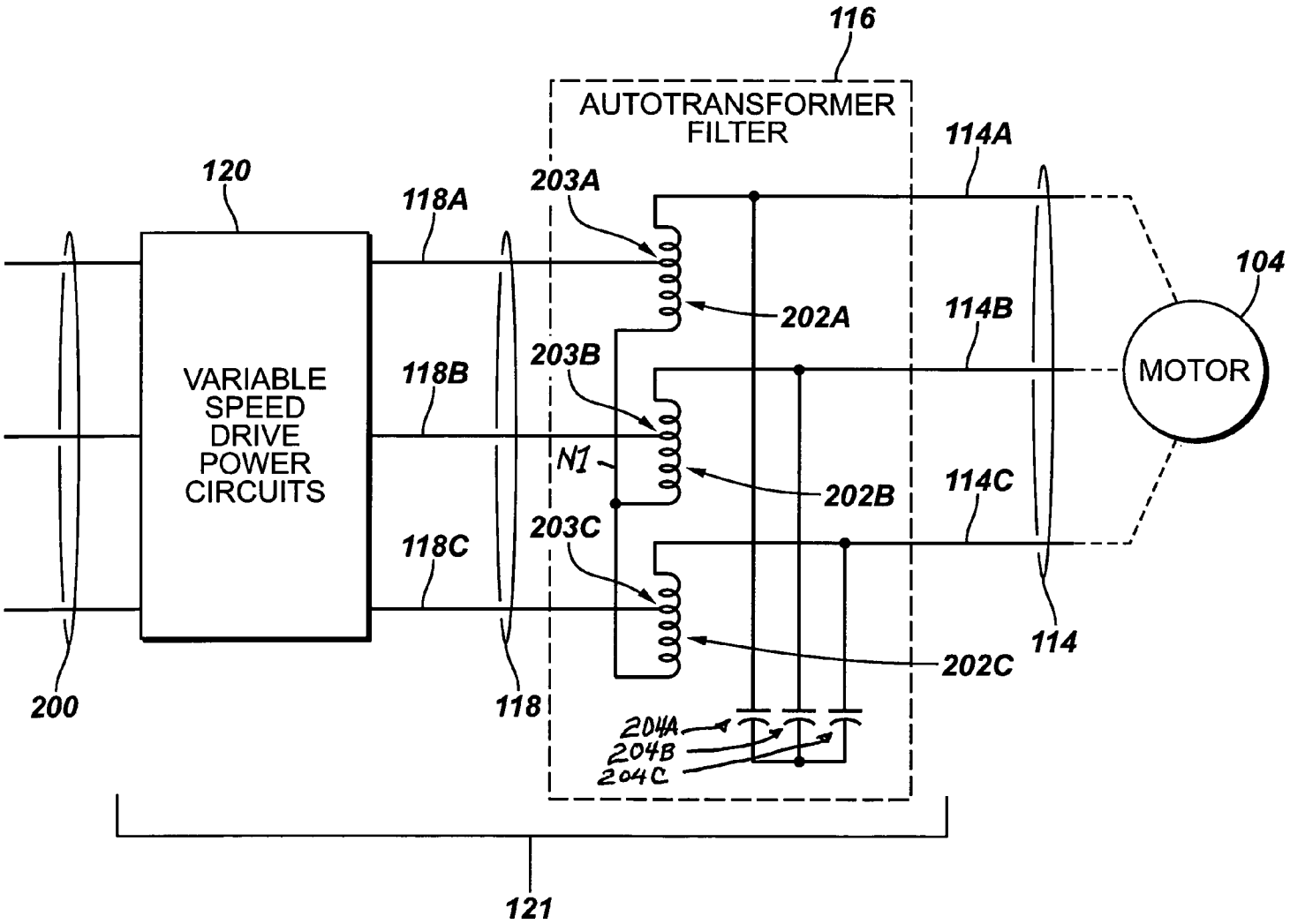
FIG. 2 is a more detailed diagram of components of the autotransformer filter according to an embodiment.

FIG. 2 illustrates components of the autotransformer filter 116 in greater detail. As depicted in FIG. 2, a three-phase input 200 is provided to the variable speed drive power circuits 120, which produces the three-phase input 118 to the autotransformer 116. The three-phase input 118 from the variable speed drive system includes three signals 118A, 118B, 118C that are out of phase with respect to each other. Each signal 118A, 118B, 118C from the variable speed drive power circuits 120 is a pulsed DC voltage signal that switches between positive and negative voltages.

The signals 118A, 118B, 118C from the variable speed drive power circuits 120 are provided to the autotransformer filter 116. Each signal 118A, 118B, 118C is provided to a tap point of a respective transformer 202A, 202B, and 202C. Each transformer 202A, 202B, and 202C includes a primary coil and secondary coil. A node of the primary coil of each of the transformers 202A, 202B, and 202C is connected to a common node N1. A node of the secondary coil of each of the transformers 202A, 202B, and 202C is connected to a respective output signal 114A, 114B, and 114C (which are part of the three-phase output 114 from the autotransformer filter 116).

Also, the output signals 114A, 114B, and 114C are connected to respective capacitors 204A, 204B, and 204C. The inductance of a respective transformer 202A, 202B, and 202C and capacitance of a respective capacitor 204A, 204B, and 204C cooperate to provide a filter to filter out certain harmonic components in a respective input signal 118A, 118B, 118C. In other words, the inductance of the transformer 202A cooperates with the capacitance of the capacitor 204A to provide a filter for input signal 118A; the inductance of the transformer 202B cooperates with the capacitance of the capacitor 204B to provide a filter for input signal 118B; and the inductance of the transformer 202C cooperates with the capacitance of the capacitor 204C to provide a filter for input signal 118C.

According to one embodiment, the harmonic components that are filtered out by the filters include high frequency components of each pulsed DC voltage input signal 118A, 118B, or 118C. Filtering the high-frequency harmonic components in each input signal 118A, 118B, 118C produces a sine wave at a respective output signal 114A, 114B, 114C. The term "sine wave" refers to a waveform of a signal that can be exactly a sine wave or approximately or generally a sine wave. Approximately or "generally" a sine wave means that a signal has a waveform shape resembling a sine wave. Each sine wave signal at the output 118 of the autotransformer 116 has reduced resonance (or no resonance) when communicated to the load impedance represented by the cable 122 and motor 104. Resonance can cause vibrations that may produce harmful results in the electrical system that includes the variable speed drive power circuits 120 and motor 104.

The tap point 203A, 203B, and 203C of the respective transformer 202A, 202B, and 202C that connect to input signal 118A, 118B, 118C enables selection of the amount of boosting for the voltage amplitude of the input signal to the voltage amplitude of the output signal. Varying the tap point 203A, 203B, and 203C of the transformers 202A, 202B, and 202C allows variation of the amount of boosting or stepping up of the amplitude of the output signal. Boosting or stepping up of the amplitude of an output signal of the autotransformer filter 116 refers to receiving an input signal at the autotransformer filter 116 having a first amplitude, and increasing the amplitude to a second, greater amplitude that defines the amplitude of the output signal from the autotransformer 116.

Varying of the tap point 203A, 203B, and 203C also allows the inductance of the transformer 202A, 202B, and 202C seen by the input signal 118A, 118B, and 118C to be varied, such that the filters provided by the autotransformer filter 116 can be adjusted.

As depicted in FIG. 2, the autotransformer 116 includes both an amplitude boosting portion and a filtering portion. The amplitude boosting portion includes the transformers 203A, 203B, and 203C. The filtering portion includes the inductance provided by the transformers 203A, 203B, and 203C, and respective capacitors 204A, 204B, and 204C. Use of the autotransformer 116 results in more simplified implementation of equipment associated with the variable speed drive power circuits 120, which reduces costs and likelihood of equipment failure. Also, the autotransformer filter 116 provides variable tap points (at the transformers 203A, 203B, and 203C) that enable adjustment of the amplitude boosting and filtering provided by the autotransformer 116.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A method comprising:

receiving, at a filter having a transformer and a capacitor, an input signal from a drive circuit, wherein the input signal is received at a variable tap point of the transformer, wherein variation of the tap point of the transformer causes variation in an inductance of the transformer experienced by the input signal, where the inductance and the capacitor cooperate to filter the input signal;

producing, by the filter, an output signal with reduced resonance; and boosting an amplitude of the output signal using the filter.

2. The method of claim 1, further comprising providing the output signal to a motor.

3. The method of claim 1, further comprising providing the output signal to a submersible motor in a well, the output signal provided over a cable that extends from earth surface equipment to the submersible motor in the well, wherein the drive circuit is part of the earth surface equipment.

4. The method of claim 3, further comprising using the submersible motor to power a pump to produce fluids from the well.

5. The method of claim 3, further comprising using the submersible motor to power a downhole component in the well.

6. The method of claim 1, further comprising varying the tap point at which the input signal is connected to the transformer to vary boosting of the amplitude of the output signal.

7. The method of claim 6, wherein varying the tap point further causes the inductance of the transformer experienced by the input signal to change.

8. The method of claim 1, wherein boosting the amplitude of the output signal comprises stepping up a first voltage amplitude of the input signal to a higher second voltage amplitude of the output signal.

9. The method of claim 1, wherein boosting the amplitude of the output signal comprises boosting a voltage amplitude of the output signal using the transformer in the filter.

10. The method of claim 9, further comprising filtering out harmonic components of the input signal using a combination of the inductance and a capacitance of the capacitor.

11. The method of claim 1, wherein the input signal is part of a three-phase input to the filter, and the output signal is part of a three-phase output produced by the filter, the method further comprising:

producing other output signals of the three-phase output with reduced resonance; and boosting an amplitude of each of the other output signals of the three-phase output.

12. The method of claim 11, wherein the filter includes three sets of filtering components to filter out harmonic components in respective input signals of the three-phase input, wherein a first of the filtering components includes the transformer and the capacitor, and the other filtering components each including a respective capacitor and transformer having a variable tap point to receive a corresponding one of the input signals.

13. An apparatus comprising:

a transformer having a variable tap point to receive an input signal from a drive circuit, the transformer to boost an amplitude of an output signal from an amplitude of the input signal; and a capacitor coupled to the output signal, wherein variation of the tap point of the transformer is to cause variation in an inductance of the transformer experienced by the input signal, where the inductance and the capacitor are cooperatively coupled to provide a filter to filter out one or more harmonic components in the input signal from the output signal, the output signal suitable for driving a motor.

14. The apparatus of claim 13, wherein variation of the tap point is to further vary an amount of boosting of the amplitude of the output signal from the amplitude of the input signal.

15. The apparatus of claim 13, wherein the input signal is one of three input signals of a three-phase input, and wherein the output signal is one of three output signals of a three-phase output, the apparatus further comprising:

a second transformer and a third transformer each having a respective variable tap point to receive a corresponding one of the input signals; and a second capacitor and a third capacitor, each transformer to boost an amplitude of a respective output signal, and each set of a respective transformer and capacitor to filter out one or more harmonic components in a respective input signal from a respective output signal.

16. A system comprising:

a variable speed drive circuit;

a filter to receive an input from the variable speed drive circuit;

a cable to be deployed in a wellbore; and a motor for deployment in the wellbore, the cable connected between the filter and the motor, the filter to provide an output over the cable based on the received input from the variable speed drive circuit, the filter having a transformer and a capacitor, the transformer having a variable tap point to receive the input, the filter to filter out harmonic components from the output provided over the cable to the motor, and the filter to boost an amplitude of the output from the filter to the motor, wherein variation of the tap point of the transformer is to cause variation in an inductance of the transformer experienced by the input signal, where the inductance and the capacitor cooperate to filter the input signal.

17. The system of claim 16, wherein the transformer is to step up an amplitude of the input to the amplitude of the output.

18. The system of claim 17, wherein the variable tap point is adjustable to vary an amount of stepping up of the amplitude.

19. The system of claim 16, wherein the input comprises a three-phase input, and the output comprises a three-phase output, and the motor comprises a three-phase motor.

20. The system of claim 19, wherein the filter comprises three transformers and three capacitors associated with the three-phase input and three-phase output.

* * * * *